US006556681B2

(12) United States Patent
King

(10) Patent No.: US 6,556,681 B2
(45) **Date of Patent: *Apr. 29, 2003**

(54) RECONFIGURABLE UNIVERSAL TRAINABLE TRANSMITTER

(75) Inventor: Joseph David King, Ann Arbor, MI (US)

(73) Assignee: Lear Corporation, Southfield, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/140,022

(22) Filed: Aug. 26, 1998

(65) Prior Publication Data

US 2002/0067826 A1 Jun. 6, 2002

(51) Int. Cl.[7] ..... H04K 1/00

(52) U.S. Cl. ..... 380/270; 380/247; 380/271; 380/272; 380/273; 380/274; 380/52; 380/44; 713/194

(58) Field of Search ..... 380/247, 270–273, 380/274, 52, 44; 713/194

(56) References Cited

U.S. PATENT DOCUMENTS

| | | | | |
|---|---|---|---|---|
| 4,593,384 A | * | 6/1986 | Kleijne | 365/288 |
| 5,552,917 A | * | 9/1996 | Darbee et al. | 359/148 |
| 5,592,555 A | * | 1/1997 | Stewart | 380/247 |
| 5,608,758 A | | 3/1997 | Sakuma et al. | |
| 5,661,804 A | | 8/1997 | Dykema et al. | 380/21 |
| 5,686,904 A | * | 11/1997 | Bruwer | 340/5.23 |
| 5,731,756 A | * | 3/1998 | Roddy | 340/539 |
| 5,748,720 A | * | 5/1998 | Loder | 379/144 |
| 5,878,142 A | * | 3/1999 | Caputo et al. | 713/159 |
| 6,118,269 A | * | 9/2000 | Davis | 324/110 |

FOREIGN PATENT DOCUMENTS

| | | |
|---|---|---|
| DE | 196 44 237 | 4/1998 |
| FR | 2 650 420 | 2/1991 |
| GB | 2 287 337 | 9/1995 |

OTHER PUBLICATIONS

International Search Report Dated Dec. 16, 1999, in International Application No. PCT/US99/19680.
Research Disclosure No. 352 for "Adaptable Remote Control Device", Aug. 1, 1993, Great Britain.

* cited by examiner

*Primary Examiner*—Gail Hayes
*Assistant Examiner*—James Seal
(74) *Attorney, Agent, or Firm*—MacMillan, Sobanski & Todd, LLC

(57) ABSTRACT

A trainable transmitter comprises a transmitter, code-generation circuitry and a removable, plug-in data module. The data module includes information necessary for generating a code for a specific security system, such as a garage door opener. Preferably, the data includes a cryptographic algorithm and the frequency at which the wireless signal is to be generated. The code-generation circuitry accesses the data in the data module to generate a code, which is then transmitted by the transmitter. A variety of data modules are provided. A user installs a data module which corresponds to the security system to be accessed.

21 Claims, 2 Drawing Sheets

RECONFIGURABLE UNIVERSAL TRAINABLE TRANSMITTER

BACKGROUND OF THE INVENTION

The present invention relates generally to wireless trainable transmitters, particularly for vehicles.

Increasing numbers of new vehicles are being sold with trainable transmitters permanently installed in the vehicle. The trainable transmitters allow consumers to train the transmitter to duplicate an existing transmitter, such as a garage door opener. This approach provides certain advantages. For example, since the transmitter is permanently installed, it is more difficult for a thief to steal the transmitter while obtaining the owner's address from the glove compartment. Further, the current trainable transmitters pre-store a plurality of cryptographic algorithms allowing the trainable transmitter to be universal. This provides convenience to the consumer by allowing the trainable transmitter to be compatible with many home products, such as garage door openers.

However, a permanently installed trainable transmitter that pre-stores a plurality of cryptographic algorithms suffers from some disadvantages. The universal trainable transmitter, by virtue of its learning capability and pre-storing a plurality of cryptographic algorithms, is simply a universal code grabber. A person with basic electrical/electronic knowledge can increase the range with commercially available RF amplifiers to convert the trainable transmitter to a code grabber. A potential thief could construct such a code grabber and steal codes from a victim's garage door opener transmitter. Since the universal trainable transmitter pre-stores a plurality of cryptographic algorithms, even advanced rolling codes could be compromised.

Further, current universal trainable transmitters cannot be upgraded to new cryptographic algorithms as the manufacturers of home products (e.g., garage doors, home security entry systems, and wireless switches) change existing codes. Additionally, a universal trainable transmitter would not be compatible with new wireless products by new manufacturers, since there is no common standard for rolling security codes. Since different manufacturers use different codes and encryption algorithms, the universal trainable transmitter cannot be 100% universal or upgradable.

SUMMARY OF THE INVENTION

The present invention provides a re-configurable trainable transmitter including a removable plug-in data module which contains a cryptographic algorithm and the other information necessary for generating a wireless signal containing a code associated with a specific security system. The trainable transmitter generally comprises a transmitter and code-generation circuitry, such as a microprocessor. The microprocessor generates a digital code based upon the data in the data module, including the cryptographic algorithm. The microprocessor determines a digital code based upon the cryptographic algorithm and the transmitter generates a wireless signal including the digital code at a frequency also specified by the data module.

Preferably, the data module is associated with a security system from a certain manufacturer or of a specified model or models. Initially, a user would obtain the correct data module necessary to operate the user's security system, such as garage door opener or home security system, either from the manufacturer of the security system or the manufacturer of the vehicle. By providing the correct plug-in data module, no learning mode would be required. Further, it would not be necessary to store the cryptographic algorithms from the many manufacturers on the trainable transmitter. Only the cryptographic algorithm to be used would be stored on the trainable transmitter.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
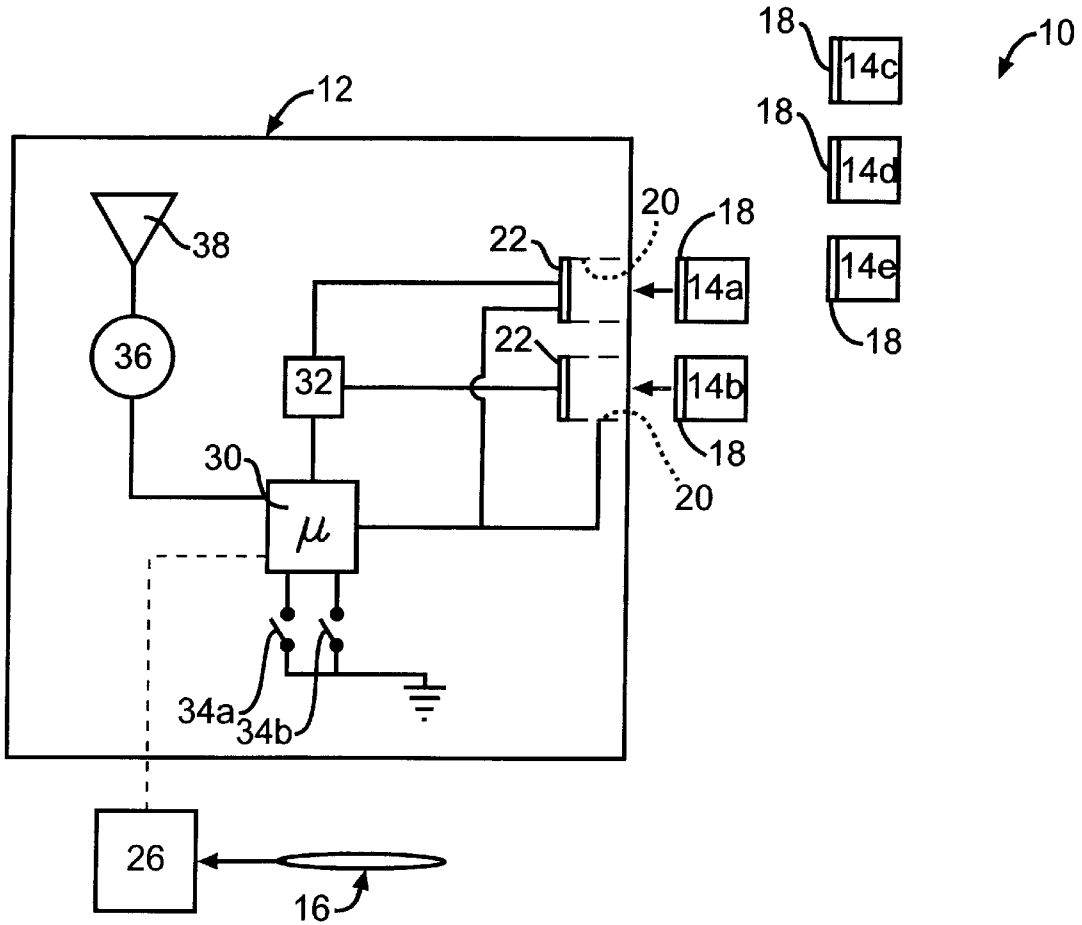
FIG. 1 is a schematic of the trainable transmitter of the present invention.

A vehicle transmitter system 10 is shown in FIG. 1 generally comprising a reconfigurable trainable transmitter 12 at a plurality of data modules 14*a–e* and 16. Preferably, the data modules 14 are each ROM chips having electrical connectors 18 such as connector pins or other known electrical connectors. The data modules 14 are each stored in a cartridge which can be handled by consumers. The data module 16 is preferably a CD ROM 16.

The data modules 14*a–e* each contain different data necessary to generate a digital code for a different security system. For example, each data module 14*a–e* contains a cryptographic algorithm for generating a rolling code and an indication of the frequency at which the wireless signal containing the digital code is to be generated. The data module 14 may also include other information regarding the modulation protocol of the wireless signal to be sent. Again, each of the data modules 14*a–e* contains only sufficient information for a single security system. Some of the data modules 14*a–e* may simply contain a single digital code, for security systems which do not use encrypted codes. Each of the data modules 14 is associated with a specific model or models from specific manufacturers of security systems, such as garage door openers.

The trainable transmitter 12 includes at least one, but alternatively more than one, socket 20 to which the data modules 14 can be connected. The socket 20 includes electrical connectors 22 which electrically connect to the electrical connector 18 on the data modules 14.

The CD ROM 16 stores "personality" information for a plurality of security systems, including cryptographic algorithms, frequencies, modulation schemes, etc. The CD ROM 16 is readable by a CD player 26 which is installed in a location remote from the trainable transmitter 12, but electrically connected to the trainable transmitter 12. The trainable transmitter 12 includes code-generation circuitry 30, preferably a microprocessor executing appropriate software. The code-generation circuitry 30 could alternatively comprise hard-wired circuitry. Tamper detection circuitry 32 is connected to the sockets 20 and the code-generation circuitry 30.

The code-generation circuitry 30 receives inputs from user-activated switches 34*a* and 34*b*. The code-generation circuitry generates a digital code and sends it to an oscillator 36, which is preferably a voltage-controlled oscillator or other variable frequency oscillator, or a plurality of discrete oscillators, such that more than one frequency can be generated. The oscillator transmits a wireless signal, preferably RF, via an antenna 38.

Figure 2:
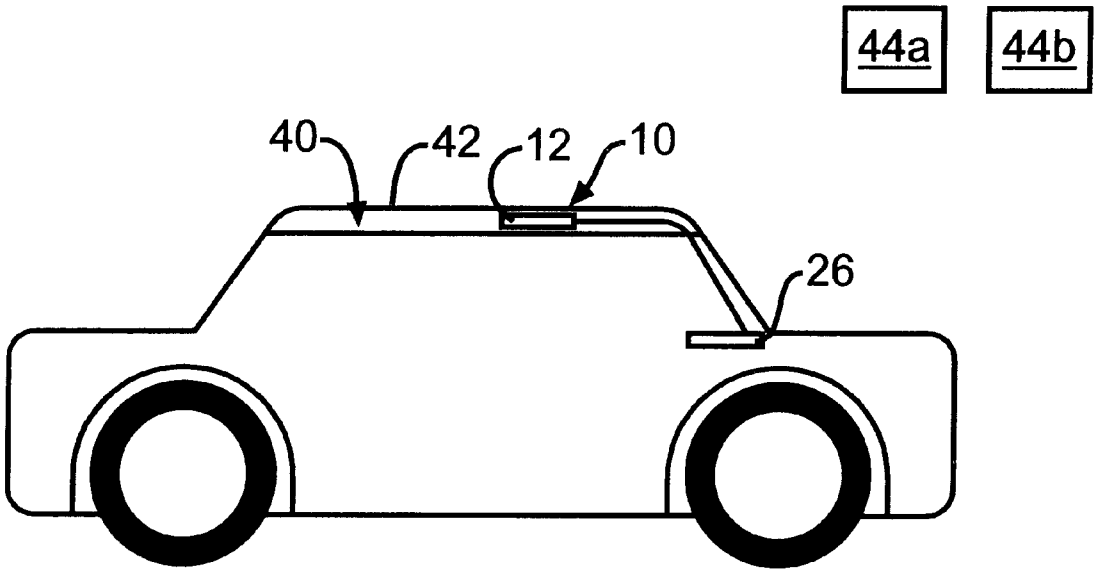
FIG. 2 illustrates the trainable transmitter installed in a vehicle.

FIG. 2 illustrates the vehicle transmitter system 10 installed in a vehicle 40. Preferably, the trainable transmitter 12 is installed in a headliner 42 of the vehicle 40. If the optional CD ROM player 26 with the CD ROM 16 is utilized, the CD player 26 and CD ROM 16 is preferably installed in the vehicle 40 at a location remote from the trainable transmitter 12 and connected via wires, or other means.

In operation, a user initially selects one of the data modules 14*a–e* which corresponds to the garage door opener (or other security system) that the user wishes the vehicle transmitter system 10 to operate. The selected data module 14 must have the same cryptographic algorithm, frequency, modulation, etc. that the receiving garage door opener receiver utilizes.

The trainable transmitter 12 is placed in a "train" mode, using user input switches 34*a–b* (or others) along with the security systems 44*a–b*. In the train mode, the trainable transmitter 12 is synchronized with the systems 44*a–b* with respect to the cryptographic algorithms. It should be noted that this is different than a "learn" mode where the cryptographic algorithm, frequency or modulation is learned from other systems. This data which is learned from other systems is supplied by the data modules 14.

In operation, referring to FIGS. 1 and 2, when the user activates one of the switches 34*a,* for example, the code-generation circuitry 30 accesses the corresponding data module 14*a* to obtain the code-generation algorithms and other data. The code-generation circuitry 30 then generates the appropriate digital code, which is transmitted via the antenna 38 by the oscillator 36. This wireless signal is received by the receiving system 44*a,* such as a garage door opener. Upon receiving the digital code, the receiving system 44*a* activates the system, such as opening or closing the garage door. When the user activates the second switch 34*b,* the code-generation circuitry 30 accesses the second data module 14*b* and generates a second digital code, based upon a second cryptographic algorithm. This second digital code is transmitted via the antenna 38 by the oscillator 36, possibly at a second frequency and utilizing a second modulation scheme. This wireless signal is received by the second receiving system 44*b,* such as a home security system, which activates the system based upon receiving the proper digital code.

The tamper detection circuitry 32 is connected to the code-generation circuitry 30 and indicates to the code-generation circuitry 30 when the trainable transmitter 12 is removed from the vehicle 40. The tamper detection circuitry 32 may simply monitor power to the trainable transmitter 12, or include an interlock connection to the vehicle such as an electrical connection to the vehicle body which when broken indicates that the trainable transmitter 12 is removed from the vehicle. Alternatively, the tamper detection circuitry can include an LED which reflects light from a surface on the vehicle 40; when the trainable transmitter 12 is removed from the vehicle 40, the light is no longer reflected from the LED off of the vehicle surface, thereby indicating that the trainable transmitter 12 has been removed.

When the tamper detection circuitry 32 detects that the trainable transmitter 12 has been removed from the vehicle 40, the trainable transmitter 12 is rendered permanently unusable in one of several ways. First, the tamper detection circuitry 32 (or the code-generation circuitry 30) can erase the data from the data modules 14*a–b* (which may be EEPROM). Alternatively, the tamper detection circuitry 32 can erase the memory in or otherwise disable the code-generation circuitry 30. In this manner, if the trainable transmitter 12 is permanently installed in the vehicle 40, unauthorized removal and use can be prevented. Of course, the tamper detection circuitry 32 would not be utilized if the trainable transmitter 12 is a portable transmitter, such as a fob.

In the alternate embodiment, utilizing the CD ROM 16, the code-generation circuitry 30 accesses the data on the CD ROM 16, when necessary to generate a digital code, i.e., upon activation of one of the user-activated switches 34*a–b*. In this embodiment, the code-generation circuitry 30 can utilize a learn mode to learn the algorithm, frequency, modulation, etc., which is then accessed from the CD ROM 16. Alternatively, the specific make and model of the security system can be indicated to the trainable transmitter 12 or CD player 26 so that the proper data is transmitted from the CD ROM 16 to the code-generation circuitry 30. In this embodiment, if the trainable transmitter 12 is ever removed from the vehicle, the data for the plurality of security systems would remain in the vehicle 40. Thus, the stolen trainable transmitter 12 would not constitute the universal code grabber. Nor would the trainable transmitter 12 be able to activate the security systems 44*a*&*b* without the data.

The trainable transmitter 12 of the present invention provides a universal trainable transmitter 12 that does not have the capability of being transformed into a universal code grabber. However, the trainable transmitter 12 can be utilized with many different security systems from different manufacturers, in conjunction with the data modules 14 and/or 16.

What is claimed is:

1. A trainable transmitter comprising:

a transmitter for transmitting a code in a wireless signal to a remote receiver; and a read-only data module removably connected to said transmitter to be carried by said transmitter during normal use, said data module including data necessary to generate said code, said trainable transmitter generating said code based on said data without receiving said data from the remote receiver.

2. The trainable transmitter of claim 1, wherein said data includes a cryptographic algorithm.

3. The trainable transmitter of claim 1, wherein said data includes a frequency at which the wireless signal should be transmitted.

4. The trainable transmitter of claim 1, wherein said data module is ROM.

5. The trainable transmitter of claim 1, wherein said data module is removably secured to said trainable transmitter.

6. The trainable transmitter of claim 1, wherein said transmitter includes code-generation circuitry circuitry for generating said code to be transmitted by said transmitter based upon said data in said data module.

7. The trainable transmitter of claim 6, further including tamper detection circuitry, said trainable transmitter disabling said code-generation based upon detection of tampering with said trainable transmitter by said tamper detection circuitry.

8. The trainable transmitter of claim 1, wherein said data module is mounted remotely from said transmitter.

9. The trainable transmitter of claim 1, wherein said transmitter is mounted in a vehicle.

10. The trainable transmitter of claim 8, wherein said data module is installed in a remote location in the vehicle from the transmitter.

11. The trainable transmitter of claim 1, wherein said data module stores a plurality of cryptographic algorithms.

12. The trainable transmitter of claim 1, wherein said data module stores said data for a plurality of wireless communication systems.

13. A read-only data module for a trainable transmitter comprising:

a read-only computer storage medium for storing data necessary for generating a code for a security system, wherein said data module is removably connected to the trainable transmitter and is carried by the transmitter during normal use, and wherein the trainable transmitter generates the code without receiving said data from the security system.

14. The data module of claim 13, wherein said data includes a cryptographic algorithm.

15. The data module of claim 13, wherein said data includes a frequency at which a wireless signal including the code is to be transmitted to the security system.

16. The data module of claim 13, wherein said storage medium is a ROM.

17. The data module of claim 13, further including a connector for providing electrical connection to a transmitter included in the trainable transmitter.

18. The data module of claim 13, wherein said data includes a plurality of cryptographic algorithms.

19. A trainable transmitter comprising:

a transmitter for transmitting a wireless signal to a remote receiver;

a ROM data module removably connected to said transmitter and carried by said transmitter during normal use, said data module for storing a cryptographic algorithm; and code-generation circuitry for generating a code, to be transmitted in the wireless signal by said transmitter, based upon said cryptographic algorithm stored in said data module without receiving said cryptographic algorithm from the remote receiver.

20. The trainable transmitter of claim 19, further comprising:

a plurality of said ROM data modules, each for storing a different cryptographic algorithm.

21. A method for generating a wireless signal including the steps of:

a) selecting a read-only data module containing a cryptographic algorithm for generating a digital code for a security system from among a plurality of read-only data modules each having a different cryptographic algorithm;

b) removably connecting the data module selected in said step a) to code-generation circuitry during normal operation of said method, where each of said plurality of data modules is removably connectable to the code-generation circuitry;

c) generating a digital code based upon the cryptographic algorithm in the selected data module in the code-generation circuitry without obtaining data necessary for generating the digital code from the security system; and d) transmitting the digital code in a wireless signal.

* * * * *